US011062817B1

(12) United States Patent
Tabor et al.

(10) Patent No.: US 11,062,817 B1
(45) Date of Patent: Jul. 13, 2021

(54) LIQUID METAL ENCAPSULATES HAVING NON-NATIVE SHELLS

(71) Applicant: Government of the United States, as represented by the Secretary of the Air Force, Wright-Patterson AFB, OH (US)

(72) Inventors: Christopher E. Tabor, Kettering, OH (US); Zachary J. Farrell, Xenia, OH (US); Nicholas J. Morris, Dayton, OH (US); Megan A Creighton, Dayton, OH (US)

(73) Assignee: United States of America as represented by the Secretary of the Air Force, WPAFB, OH (US)

( * ) Notice: Subject to any disclaimer, the term of this patent is extended or adjusted under 35 U.S.C. 154(b) by 0 days.

(21) Appl. No.: 16/925,668

(22) Filed: Jul. 10, 2020

Related U.S. Application Data

(60) Provisional application No. 62/873,313, filed on Jul. 12, 2019.

(51) Int. Cl.
*H01B 1/02* (2006.01)
*C23C 26/00* (2006.01)

(52) U.S. Cl.
CPC ..... *H01B 1/02* (2013.01); *C23C 26/00* (2013.01)

(58) Field of Classification Search
CPC ..... H01B 1/02
See application file for complete search history.

(56) References Cited

U.S. PATENT DOCUMENTS

| | | | | |
|---|---|---|---|---|
| 5,198,189 | A | 3/1993 | Booth et al. | |
| 7,491,892 | B2 | 2/2009 | Wagner et al. | |
| 8,485,245 | B1 * | 7/2013 | Prest | B22D 11/06 164/479 |
| 9,859,226 | B1 * | 1/2018 | Campbell | H01L 23/06 |
| 9,930,773 | B2 | 3/2018 | Holbery et al. | |
| 2003/0215394 | A1 | 11/2003 | Short et al. | |
| 2005/0284232 | A1 | 12/2005 | Rice | |
| 2008/0277631 | A1 | 11/2008 | Smela et al. | |
| 2013/0244037 | A1 | 9/2013 | Hohman et al. | |
| 2014/0147959 | A1 | 5/2014 | Ratcurt et al. | |
| 2016/0049227 | A1 | 2/2016 | Bottiglio et al. | |
| 2016/0218287 | A1 | 7/2016 | McAlpine et al. | |
| 2016/0317992 | A1 * | 11/2016 | Thuo | B23K 35/0244 |
| 2017/0089774 | A1 | 3/2017 | Rykaczewski et al. | |
| 2017/0218167 | A1 | 8/2017 | Majidi et al. | |
| 2017/0235021 | A1 | 8/2017 | Boley et al. | |
| 2018/0029290 | A1 | 2/2018 | Bottiglio et al. | |

OTHER PUBLICATIONS

Zhu, P.: Gao, S.; Lin, H.; Lu, X.: Yang, B.; Zhang, L.; Chen, Y.; Shi, J.; Inorganic Nanoshell-Stabilized Liquid Metal for Targeted Photonanomedicine in NIR-II Biowindow Nano Lett. 2019, 19, 2128-2137.

* cited by examiner

*Primary Examiner* — William D Young
(74) *Attorney, Agent, or Firm* — AFMCLO/JAZ; James F. McBride

(57) ABSTRACT

The present invention relates to core shell liquid metal encapsulates comprising and processes of making and using such encapsulates and networks. The shell(s) of such encapsulates employ a palette of materials having widely varied band structures and/or the desired spin pairing and/or bond polarization. Such encapsulates can be designed to respond to one or more stimuli of choice, including but not limited to electromagnetic, thermal, mechanical, photonic, and/or magnetic and are environmentally robust.

18 Claims, 1 Drawing Sheet

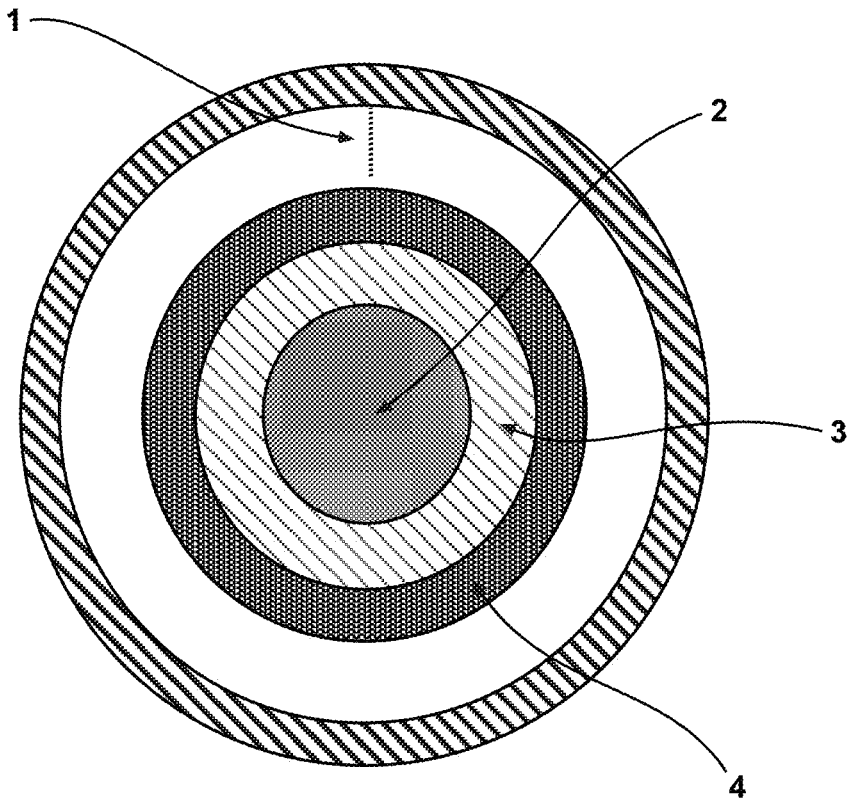
1
2
3
4

LIQUID METAL ENCAPSULATES HAVING NON-NATIVE SHELLS

CROSS-REFERENCE TO RELATED APPLICATION

The present application claims priority to U.S. Provisional Application Ser. No. 62/873,313 filed Jul. 12, 2019, the contents of which is hereby incorporated by reference in their entry.

RIGHTS OF THE GOVERNMENT

The invention described herein may be manufactured and used by or for the Government of the United States for all governmental purposes without the payment of any royalty.

FIELD OF THE INVENTION

The present invention relates to core shell liquid metal encapsulates comprising one or more shells and processes of making and using such encapsulates.

BACKGROUND OF THE INVENTION

Current liquid metal encapsulates comprise shells that are made of native shells such as gallium oxide or indium oxide. Unfortunately, such encapsulates only respond to mechanical stimuli and their environmental robustness is less than desired. Thus, what is needed is an encapsulate that minimizes the aforementioned problems.

Applicants recognized that the source of the aforementioned problems lie in the fact that native shell materials have an electronic band structure that is intrinsically limiting as the band gap is fixed and will not allow electrons to travel or not travel as desired, have undesirable bond polarization and/or have an undesirable spin pairing of electrons in their highest level d and/or f orbitals. Applicants discovered that replacing and/or supplementing native shell materials with a palette of materials having widely varied band structures and/or the desired spin pairing and/or bond polarization was the solution to the aforementioned problems. Thus, Applicants disclose improved core shell liquid metal encapsulates and processes of making and using same. Such encapsulates can be designed to respond to one or more stimuli of choice and are environmentally robust.

SUMMARY OF THE INVENTION

The present invention relates to core shell liquid metal encapsulates comprising and processes of making and using such encapsulates and networks. The shell(s) of such encapsulates employ a palette of materials having widely varied band structures and/or the desired spin pairing and/or bond polarization. Such encapsulates can be designed to respond to one or more stimuli of choice, including but not limited to electromagnetic, thermal, mechanical, photonic, and/or magnetic and are environmentally robust.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

FIG. 1 is a cross-sectional view of a liquid metal encapsulate having one or more non-native shells.

DETAILED DESCRIPTION OF THE INVENTION

Definitions

Unless specifically stated otherwise, as used herein, the terms "a", "an" and "the" mean "at least one".

As used herein, the terms "include", "includes" and "including" are meant to be non-limiting.

As used in this specification the terms "encapsulate" and "particle" are synonymous.

As used in this specification, the term "EGaIn" is used to denote an alloy composed of 85.8% Ga, 14.2% In on an atomic basis.

As used in this specification, the term "Field's Metal" is used to denote an alloy composed of 32.5% Bi, 51% In, 16.5% Sn by mass.

All references in this specification to ImageJ software are to ImageJ software Version 1.51n.

As used in this specification, the term "liquid metal" means a metal or alloy of metals that possesses a liquidus of no greater than 300° C. at a given composition at one atmosphere of pressure as measured in bulk form.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition weight unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Liquid Metal Encapsulate Having One or More Non-Native Shells

For purposes of this specification, headings are not considered paragraphs and thus this paragraph is Paragraph 0020 of the present specification. The individual number of each paragraph above and below this paragraph can be determined by reference to this paragraph's number. In this paragraph 0020, Applicants disclose an encapsulate comprising:

a) a liquid metal core, said liquid metal core comprising a liquid metal selected from the group consisting of:

(i) Hg, In, Ga and mixtures thereof, preferably In, Ga and mixtures thereof; and/or (ii) an alloy comprising Hg, Sn, In, and/or Ga; and Pb, Sb, Cd, Bi, Al, Zn, Ag, Au, Tl and mixtures thereof; preferably said alloy comprises In and/or Ga, and Bi, Pb, Cd, Sb and mixtures thereof; more preferably said alloy comprises In and/or Ga, and Bi, Sb and mixtures thereof; most preferably said liquid metal is selected from the group consisting of Ga, In and mixtures thereof;

b) one or more shells that encapsulate said liquid metal, said one or more shells comprising a first shell comprising:

(i) a two dimensional material, preferably said two dimensional material being selected from the group consisting of graphene oxide, graphene, modified graphene, modified graphene oxide, boron nitride, modified boron nitride, transition metal dichalcogenides, transition metal tri-chalcogenides, clays, MXenes, and mixtures thereof, more preferably said two dimensional material being selected from the group consisting of graphene oxide, modified graphene oxide, transition metal dichalcogenides, clays and mixtures thereof, most preferably said two dimensional material being selected from the group consisting of graphene oxide, modified graphene oxide and mixtures thereof; or (ii) a charge neutral ceramic comprising an anion and a cation, each anion being independently selected from the group consisting of O, N, F, P, S, and each cation being independently selected from the group consisting of Ga, In, Sn, Pb, Sb, Cd, Al, Zn, Tl, Bi, Ca, Sc, Ti, V, Cr, Sr, Y, Zr, Nb, Mo, Te, Gd, Hf, Pr, Nd, Pt, Sm, Eu, Dy, Ho, Er, Yb, Pu, preferably each anion being independently selected from the group consisting of O, N, F, P, and S and each cation being independently selected from the group consisting of Ga, In, Sn, Pb, Sb, Cd, Al, Zn, Tl, Bi, Ca, Sc, Ti, V, Cr, Sr, Y, Zr, Nb, Mo, Te, Gd, Hf, Pr, Nd, Pt, Sm, Eu, Dy, Ho, Er, Yb, Pu and mixtures thereof; more preferably each anion being independently selected from the group consisting of O, N, and F, and each cation being independently selected from the group consisting of Ga, In, Sn, Al, Zn, Sc, Ti, Cr, Zr, Nb, Gd, Nd, Sm and mixtures thereof; most preferably said anion is O and said cation is independently selected from the group consisting of Ga, In, Sn, Al, Zn, Gd, Nd and mixtures thereof, with the provisos that when said cation is Ga, In and/or Sn, said encapsulate comprises a second shell selected from a ceramic and/or a two dimensional material, that when said liquid metal core is Hg, said encapsulate's first shell comprises a two dimensional material, and when said encapsulate's core consists of Ga and In, said encapsulate comprises a first shell encapsulating said core, said first shell consisting of amorphous gallium oxide, and a second shell encapsulating said first shell, said second shell consisting of silica said encapsulate's core Ga/In cores is a 85.8 atom % Ga/14.2 atom % In core. The 85.8 atom % Ga/14.2 atom % In core is superior to a 83.2 atom % Ga/16.8 atom % In core as the normalized electrical resistance under cyclic strain is lower than for the 83.2 atom % Ga/16.8 atom % In core encapsulates. This benefit leads to lower power transmission losses in high-strain applications such as soft robotics or sensors.

Applicants disclose an encapsulate according to Paragraph 0020 wherein:

a) said modified graphene is selected from the group consisting of:

(i) a graphene surfactant mixture;

(ii) graphene comprising a functional group that comprises oxygen, preferably said functional group is selected from the group consisting of carboxylates, alcohols, ketones, carbonyls, or epoxides;

(iii) graphene comprising a functional group that comprises sulfur, preferably said functional group is selected from the group consisting of sulfonates, thiols, and mixtures thereof;

(iv) graphene comprising a functional group that comprises nitrogen, preferably said functional group is selected from the group consisting of amines, azides and mixtures thereof;

preferably said modified graphene is a graphene surfactant mixture;

b) said modified graphene oxide is selected from the group consisting of:

(i) reduced graphene oxide;

(ii) graphene oxide comprising a functional group that comprises sulfur, preferably said functional group is selected from the group consisting of sulfonates, thiols, and mixtures thereof;

(ii) graphene oxide comprising a functional group that comprises nitrogen, preferably said functional group is selected from the group consisting of amines, azides and mixtures thereof, preferably said modified graphene comprises a functional group that comprises sulfur, preferably said functional group is selected from the group consisting of sulfonates, thiols, and mixtures thereof;

c) said modified boron nitride is selected from the group consisting of:

(i) a boron nitride surfactant mixture;

(ii) boron nitride comprising a functional group that comprises oxygen, preferably said functional group is selected from the group consisting of carboxylates, alcohols, ketones, carbonyls, or epoxides;

(iii) boron nitride comprising a functional group that comprises sulfur, preferably said functional group is selected from the group consisting of sulfonates, thiols, and mixtures thereof;

(iv) boron nitride comprising a functional group that comprises nitrogen, preferably said functional group is selected from the group consisting of amines, azides and mixtures thereof;

preferably said modified boron nitride is a boron nitride surfactant mixture;

d) said transition metal dichalcogenides are transition metal dichalcogenides wherein said transition metal is selected from the group consisting of Ti, Zr, Hf, V, Nb, Ta, Mo, W, Tc, Re, Co, Rh, Ir, Ni, Pd, Pt and said dichalcogenides are selected from the group consisting of S, Se and Te; preferably said transition metal is selected from the group consisting of Mo, and W, and said dichalcogenides are selected from the group consisting of S, Se and Te; more preferably said transition metal is selected from the group consisting of Mo and W, and said dichalcogenides are selected from the group consisting of S and Se; most preferably said transition metal is Mo and said dichalcogenides are selected from the group consisting of S and Se;

e) said transition metal trichalcogenides are transition metal trichalcogenides wherein said transition metal is selected from the group consisting of Ti, Zr, Hf, Nb, Ta, and said trichalcogenides are selected from the group consisting of S, Se and Te;

f) said clay is selected from the group consisting of vermiculite, kaolin, cloisite, montmorillonite, bentonite, laponite, and mixtures thereof;

g) said MXenes are MXenes that comprise C or N; and a transition metal selected from the group consisting of Sc, Ti, V, Cr, Zr, Nb, Mo, Hf and Ta.

Applicants disclose an encapsulate according to Paragraphs 0020 through 0021, said encapsulate comprising one or more shells in addition to said first shell, said one or more shells encapsulating said first shell, said one or more shells comprising a material selected from the group consisting of a ceramic, a two dimensional material, an elemental metal, a polymer and mixtures thereof, preferably, said one or more shells comprises a material selected from the group consisting of graphene oxide, thiolated graphene oxide, molybdenum disulfide, silica, iron oxide, silver, and mixtures thereof, more preferably, said one or more shells comprises a material selected from the group consisting of graphene oxide, molybdenum disulfide, silica, iron oxide, and mixtures thereof, most preferably, said one or more shells comprises a material selected from the group consisting of graphene oxide, silica, and mixtures thereof.

Applicants disclose an encapsulate according to Paragraphs 0020 through 0022 wherein said encapsulate's liquid metal core comprising a liquid metal alloy, said liquid metal alloy being selected from the group consisting of Ga/In, Ga/In/Sn, Ga/In/Sn/Sb, In/Sn/Bi, Bi/Pb/Sn, Bi/Pb/Sn/Cd, Bi/Pb/Sn/Cd/In, Zn/In/Ga and mixtures thereof; preferably said liquid metal alloy is selected from the group consisting of Ga/In, Ga/In/Sn, Ga/In/Sn/Sb, In/Sn/Bi, Zn/In/Ga and mixtures thereof; more preferably said liquid metal alloy is selected from the group consisting of 85.8 atom % Ga/14.2 atom % In; 78.3 atom % Ga/14.9 atom % In/6.8 atom % Sn; 5 at % Zn, 20 at % In, 75 at % Ga and mixtures thereof.

Applicants disclose an encapsulate according to Paragraphs 0020 through 0023, said encapsulate's first shell having a shell thickness of from about 0.3 nanometers to about 10 nanometers and said one or more shells that are in addition to said first shell each having a shell thickness of from about 0.3 nanometers to about 10,000 nanometers, preferably, said encapsulate's first shell having a shell thickness of from about 0.3 nanometers to about 5 nanometers and said one or more shells that are in addition to said first shell each having a shell thickness of from about 0.3 nanometers to about 1,000 nanometers, more preferably, said encapsulate's first shell having a shell thickness of from about 0.3 nanometers to about 3 nanometers and said one or more shells that are in addition to said first shell each having a shell thickness of from about 0.3 nanometers to about 100 nanometers, most preferably, said encapsulate's first shell having a shell thickness of from about 0.3 nanometers to about 3 nanometers and said one or more shells that are in addition to said first shell each having a shell thickness of from about 0.3 nanometers to about 20 nanometers.

Applicants disclose an encapsulate according to Paragraphs 0020 through 0024, said encapsulate having a principal dimension of from about 5 nanometers to about 5 millimeters, preferably, said encapsulate having a principal dimension of from about 5 nanometers to about 100,000 nanometers, more preferably, said encapsulate having a principal dimension of from about 100 nanometers to about 10,000 nanometers, most preferably, said encapsulate having a principal dimension of from about 200 nanometers to about 1,000 nanometers.

FIG. 1 is shows an exemplary liquid metal encapsulate having one or more non-native shells wherein 1 is n additional optional non-native ceramic, 2-D material, metal or polymer shells; 2 is a liquid metal core; 3 is a first of a native oxide or 2-D material; and 4 is a second shell of non-native ceramic 2-D material, metal or polymer.

Process of Making Liquid Metal Encapsulate Having One or More Non-Native Shells

Applicants disclose a process of producing an encapsulate comprising a liquid metal core and one or more shells that encapsulate said liquid metal core, said process comprising:

a) contacting a liquid metal core, said liquid metal core comprising a liquid metal selected from the group consisting of:
   (i) Hg, In, Ga and mixtures thereof, preferably In, Ga and mixtures thereof; and/or
   (ii) an alloy comprising Hg, Sn, In, and/or Ga; and Pb, Sb, Cd, Bi, Al, Zn, Ag, Au, Tl and mixtures thereof; preferably said alloy comprises In and/or Ga, and Bi, Pb, Cd, Sb and mixtures thereof; more preferably said alloy comprises In and/or Ga, and Bi, Sb and mixtures thereof; most preferably said liquid metal is selected from the group consisting of Ga, In and mixtures thereof;
   with a two dimensional material, preferably said two dimensional material being selected from the group consisting of graphene oxide, graphene, modified graphene, modified graphene oxide, boron nitride, modified boron nitride, transition metal dichalcogenides, transition metal tri-chalcogenides, clays, MXenes, and mixtures thereof, more preferably said two dimensional material is selected from the group consisting of graphene oxide, modified graphene oxide, transition metal dichalcogenides, clays and mixtures thereof, most preferably said two dimensional material is selected from the group consisting of graphene oxide, modified graphene oxide and mixtures thereof; or b) contacting a liquid metal core, said liquid metal core comprising a liquid metal selected from the group consisting of:
   (i) Hg, In, Ga and mixtures thereof, preferably In, Ga and mixtures thereof; and/or
   (ii) an alloy comprising Hg, Sn, In, and/or Ga; and Pb, Sb, Cd, Bi, Al, Zn, Ag, Au, Tl and mixtures thereof; preferably said alloy comprises In and/or Ga, and Bi, Pb, Cd, Sb and mixtures thereof; more preferably said alloy comprises In and/or Ga, and Bi, Sb and mixtures thereof; most preferably said liquid metal is selected from the group consisting of Ga, In and mixtures thereof;
   with one or more anions of O, N, F, P and/or S, preferably with one or more anions of O, F and/or S; more preferably with one or more anions of O and/or F, most preferably with one or more anions of O.

Applicants disclose a process according to Paragraph 0027, wherein said liquid metal core that is contacted with said one or more anions of O, N, F, P and/or S, comprises Pb, Sb, Cd, Al, Zn, Tl, Bi, Ca, Sc, Ti, V, Cr, Sr, Y, Zr, Nb, Mo, Te, Gd, Hf, Pr, Nd, Pt, Sm, Eu, Dy, Ho, Er, Yb, and/or Pu, preferably said liquid metal core comprises Pb, Sb, Cd, Al, Zn, Tl, Bi, Ca, Sc, Ti, V, Cr, Sr, Y, Zr, Nb, Mo, Te, Gd, Hf, Pr, Nd, Pt, Sm, Eu, Dy, Ho, Er, Yb, Pu; more preferably said liquid metal core comprises Al, Zn, Sc, Ti, Cr, Zr, Nb, Gd, Nd, and/or Sm; most preferably said liquid metal core comprises Al, Zn, Gd, and/or Nd.

Applicants disclose a process according to Paragraphs 0027 through 0028 wherein said liquid metal core which has been contacted with said one or more anions of O, N, F, P and/or S is subsequently contacted with a material selected from the group comprising silica, iron oxides, lanthanide oxides, silver, and mixtures thereof, preferably, said liquid metal core which has been contacted with said one or more anions of O, N, F, P and/or S is subsequently contacted with a material selected from the group comprising silica, iron oxides, and mixtures thereof, more preferably, said liquid metal core which has been contacted with said one or more anions of O, N, F, P and/or S is subsequently contacted with a material selected from the group comprising silica, iron oxides, and mixtures thereof, said subsequent contacting comprising sol-gel and coprecipitation processing, most preferably, said liquid metal core which has been contacted with said one or more anions of O, N, F, P and/or S is subsequently contacted with a material selected from the group comprising silica, iron oxides, and mixtures thereof with the proviso that when said material is silica, Stöber sol-gel nucleation and growth processing is employed, when said material is an iron oxide, co-precipitation, followed by nucleation and growth processing is employed and when said material is a mixture of silica and iron oxide Stöber sol-gel nucleation and growth processing and co-precipitation, followed by nucleation and growth processing are employed simultaneously.

Applicants disclose a process according to Paragraph 0027 wherein said contacting comprises dispersing said liquid metal core and said two dimensional material in a solvent selected from the group comprising water, aliphatic alcohols and mixtures thereof, preferably said solvent comprises water and has a pH of 3 or less or a pH of 11 or greater and said aliphatic alcohol is ethanol, more preferably said solvent comprises water and has a pH of 3 or less or a pH of 11 or greater, most preferably said solvent has a pH greater than 11 and comprises water.

Methods of Using Liquid Metal Encapsulate Having One or More Non-Native Shells

Applicants disclose a method of using the encapsulate of Paragraphs 0020 through 0025 comprising:

a) connecting two or more electrical connections with a connector comprising said encapsulates, said connector being a solid, a liquid or a liquid comprising a solid; preferably said connector is electrically, photonically, thermally, mechanically, and/or magnetically responsive; more preferably said connector is electrically, photonically, mechanically; most preferably said connector is mechanically responsive;

b) connecting two or more thermal connections with a connector comprising said encapsulates, said connector being a solid, a liquid or a liquid comprising a solid; preferably said connector is electrically, photonically, thermally, mechanically, and/or magnetically responsive; more preferably said connector is photonically, thermally, mechanically responsive; most preferably said connector is mechanically responsive.

Applicants disclose a method of using an encapsulate according to Paragraph 0031 wherein said connector's electrical responsiveness comprises radio frequency responsiveness; said connector's photonic responsiveness comprises infrared responsiveness and/or intense pulsed light responsiveness; and said connector's mechanical responsiveness comprises tension, compression and/or shear responsiveness.

Applicants disclose a method of using a liquid metal encapsulate by generating a photonically responsive conductive traces originating from graphene oxide reducing to graphene and electrically connecting particles.

Test Methods

Determination of Encapsulate Principal Dimension

Preparation of Sizing Encapsulates in the Size Range of 10 nanometers to 500 nanometers.

Encapsulates are sized using high-resolution scanning transmission electron microscope (STEM) images taken with a high-angle annular dark-field detector on a transmission electron microscope operating at an accelerating voltage of 200,000 electron volts. Encapsulate particles are mounted for STEM measurements by first adding 50 microliters of a given encapsulate suspension having an encapsulate concentration range between $1*10^{-5}$ and $1*10^{-4}$ millimolar to 2 milliliters of anhydrous tetrahydrofuran followed by dropping this diluted suspension onto a 400-mesh copper, carbon-film coated transmission electron microscopy grid held in self-closing, anti-capillary tweezers until a single drop falls from the grid. Following deposition, a folded piece of filter paper is used to wick excess solvent from the grid underside.

Preparation of Sizing Encapsulates in the Size Range of 501 nanometers to 5,000,000 nanometers (5 millimeters).

The encapsulates are prepared for measurement by first drop casting films on copper tape and coating the encapsulates in 10 nanometers of iridium. Encapsulates are characterized using scanning electron microscopy (SEM) at an accelerating voltage of 1000 volts and with an aperture of 20 micrometers.

ImageJ software (freely available from the National Institute of Health) is used to open images corresponding to each sample and to manually draw lines bisecting encapsulates along their longest dimension, followed by recording the length of each line drawn. This process is repeated for at least 300 encapsulates in each sample. Following measurement, the average diameter is collected from the tabulated data Shell Thickness—Scanning Transmission Electron Microscopy (STEM)

STEM images of encapsulate particles are collected using a high-angle annular dark field detector (HAADF) with the sample placed such that the defocus required to achieve maximum image sharpness for each region of interest is no more than 200 nm from the sample eucentric height. Images collected in this way are processed using the "Find Edges" routine built into the software package ImageJ which uses a Sobel image filter to highlight spatial changes in image contrast. As STEM-HAADF images provide contrast based on the atomic number of the elements imaged, oxide shells possess a difference in signal from the encapsulate core and any adventitious carbon overlayer. Additionally, in the case of multiple encapsulating shells of dissimilar material, each dissimilar material junction will also possess an atomic number difference which leads to a difference in signal between materials. The "Find Edges" function reveals two lines bordering any encapsulating shell; one line corresponds to the shell inner edge and one line corresponds to the shell outer edge. An intensity profile is generated within ImageJ by drawing a line which perpendicularly bisects the shell inner and outer edges followed by selection of the "Plot Profile" function. A line is then drawn on the resultant profile between the intensity maxima and a measurement taken of this distance. 50 of these measurements are taken and averaged to calculate the average encapsulate shell thickness.

Mechanical Properties of Liquid Metal Encapsulates—Nanoindentation Testing

Mechanical properties of liquid metal encapsulates should be determined via nanoindentation. Nanoindentation measurements should be performed using a MTS Nano XP Nanoindentation system with flat punch diamond tips with diameters of 10 and 50 micron. The encapsulate that is to be measured should be cast as a submonolayer film on a flat silicon wafer, which is mounted directly onto flat, 1¼-inch diameter aluminum sample stubs. Scotch tape should be placed on the edges of the samples to secure them to the aluminum stub, while maintaining sample flatness. Indents should be run in load-control mode with a constant loading rate of 1 millinewtons per minute to the point at which the deflection of the encapsulate is 10% of the encapsulate diameter. An approach velocity of 10 nanometers per second at a distance of 1000 nanometers should be used with a surface detection stiffness threshold sensitivity of 10%.

The average encapsulate coverage for each sample should be estimated using SEM images taken within 200 microns of the indentation sites. Image analysis software (ImageJ, NIH) should be used to measure the percentage of substrate area covered with sub-monolayer encapsulate films. This percentage of area covered with encapsulate should be then used to normalize stiffness measurements to a per encapsulate domain, based on average number of encapsulate loaded by the indenter tip.

To characterize the critical load associated with encapsulate rupture and resultant release of the liquid metal core, nanoindentation measurement should be conducted with an electrically conductive, flat punch doped-diamond tip, with an electrical resistivity of 0.04 ohm meters and a diameter of 10 microns. The encapsulate that is to be measured should be cast on a 1-inch×1-inch piece of indium tin oxide coated glass. A digital multimeter and datalogger should be used to measure the in situ electrical resistance between the conductive ITO-patterned glass and the nanoindenter head housing the conductive tip during indentation experiments.

EXAMPLES

The following examples illustrate particular properties and advantages of some of the embodiments of the present invention. Furthermore, these are examples of reduction to practice of the present invention and confirmation that the principles described in the present invention are therefore valid but should not be construed as in any way limiting the scope of the invention.

Example 1—Production of an Encapsulate Having a First Shell Comprising 2-Dimensional Materials Gallium and Indium were combined to produce a eutectic liquid alloy of Gain (14.2 atom % In, 85.8 atom % Ga). An aliquot of 60 ul of this alloy was then added to 10 mL of 0.1M NaOH solution with and without 50 mg of graphene oxide and bath sonicated for 60 minutes. The produced particles were then dried and imaged by SEM. In the case without graphene oxide, no particles are formed. In the case comprising graphene oxide, distinct particles are ready apparent with graphene oxide coatings.

Example 2—Production of an Encapsulate Having a First Shell Comprising 2-Dimensional Materials The procedure of Example 1 was followed except that 10 mL of 0.1 HCl is used in lieu of NaOH. The produced particles were then dried and imaged by SEM. In the case without graphene oxide, no particles are formed. In the case comprising graphene oxide, distinct particles are ready apparent with graphene oxide coatings.

Example 3—Production of an Encapsulate Having a First Shell Comprising 2-Dimensional Materials The procedure of Example 1 was followed except that $MoS_2$ is used in lieu of graphene oxide. The produced particles were then dried and imaged by SEM. In the case without $MoS_2$, no particles are formed. In the case comprising $MoS_2$, distinct particles are ready apparent with graphene oxide coatings.

Example 4—Production of an Encapsulate Having a Liquid Metal Core Comprising EGaIn, a First Shell Comprising Gallium Oxide and a Second Shell Comprising Silica Gallium and Indium were combined to produce a eutectic liquid alloy of Gain (14.2 atom % In, 85.8 atom % Ga). 0.1 mL of this alloy was then added to 15 mL of ethanol in a 28 mm OD polypropylene vial. A 5 mm ultrasonic probe tapered microtip driven by a Sonics and Materials, Inc. VCX500 ultrasonic processor was then immersed approximately half of the vial height into the ethanol. This was operated at 30% amplitude for 30 minutes, while holding the temperature constant at 10° C. via a chilled water bath. To these encapsulates possessing an EGaIn core and a gallium oxide first shell was added 1 mL tetraethyl orthosilicate (TEOS), 0.107 mL water, and 0.5 mL of a 30% solution of ammonia in water. This led to the base-catalyzed hydrolysis of the Si—O bonds in TEOS and the heterogeneous nucleation of silica on the gallium oxide first shell of the encapsulates. This shell eventually became continuous and thickened as the TEOS was depleted from solution. The final encapsulates comprising an EGaIn core, a gallium oxide first shell, and a silica second shell were recovered from suspension via three centrifugation/wash cycles at 6000 RCF for 30 minutes followed by replacement of the supernatant with fresh ethanol. The final suspensions were dispersed into anhydrous tetrahydrofuran prior to any characterization.

Example 5—Production of an Encapsulate Having a Liquid Metal Core Comprising Ga—In—Sn Alloy, a First Shell Comprising Gallium Oxide, and a Second Shell Comprising Silica Gallium, indium, and tin were combined in the amounts 68 at % Ga, 22 at % In, 10 at % Sn via heating at 60° C. in a borosilicate glass vial. This material was ultrasonically processed as in Example 4 except Ga—In—Sn alloy is substituted for EGaIn. To these encapsulates possessing a Ga—In—Sn alloy core and a gallium oxide first shell is added 1 mL tetraethyl orthosilicate (TEOS), 0.107 mL water, and 0.5 mL of a 30% solution of ammonia in water. This leads to the base-catalyzed hydrolysis of the Si—O bonds in TEOS and the heterogeneous nucleation of silica on the gallium oxide first shell of the encapsulates. This shell eventually becomes continuous and thickened as the TEOS is depleted from solution. The final encapsulates comprising a Ga—In—Sn alloy core, a gallium oxide first shell, and a silica second shell are recovered from suspension via three centrifugation/wash cycles at 6000 RCF for 30 minutes followed by replacement of the supernatant with fresh ethanol.

Example 6—Production of an Encapsulate Having a Liquid Metal Core Comprising Field's Metal, a First Shell Comprising Indium Oxide, and a Second Shell Comprising Silica Indium, bismuth, and tin are combined in a borosilicate vial in the amount of 32.5% Bi, 51% In, 16.5% Sn by mass. This vial is then heated to 100° C. for 16 hours to completely alloy the respective elements. This material is ultrasonically processed as described in Example 4, except Field's metal is substituted for EGaIn, ethylene glycol is substituted for ethanol, a borosilicate glass vial instead of polypropylene, and the temperature of the vial is maintained at 80° C. during processing. Silica shells are then deposited onto these encapsulates possessing a Field's metal core and an indium oxide first shell as described in Example 5 to produce the final encapsulates possessing a Field's metal core, an indium oxide first shell, and a silica second shell.

Example 7—Production of an Encapsulate Having a Liquid Metal Core Comprising Ga—in Alloy, a First Shell Comprising Zinc Oxide and a Second Shell Comprising Silica Gallium, indium, and zinc were combined to produce a liquid metal alloy of Zn—Ga—In (5 at % Zn, 20 at % In, 75 at % Ga) by adding a total of 50 g of metal shot in the appropriate ratio to a borosilicate glass vial along with 1 g of stearic acid. The lid was placed on the vial and the vial was gently shaken and inverted several times for a period of around 1 minute to distribute the stearic acid throughout the sample. The vial lid was removed and the vial was then placed into a vacuum oven at 200° C., which was subsequently evacuated to a vacuum of 80 torr; the materials were allowed to alloy under these conditions for 16 hours. Following this time period, the vial was removed from the oven, and residual liquid stearic acid was pipetted from the top of the sample while it was still hot using a glass pipette tip with a natural rubber bulb. After cooling to room temperature, the vial was capped for later use and placed into a nitrogen purged drybox. To make the encapsulates, the vial was brought back up to 200° C. in a sand bath on a hot plate and allowed to equilibrate for 30 minutes. A second borosilicate glass vial was prepared containing 15 mL diethylene glycol dibutyl ether (DEGDE) and was placed into a second sand bath in a temperature controlled heating mantle held at 200° C. and allowed to equilibrate for 30 minutes. A calibrated, borosilicate glass pipette was attached to a silicone pipette bulb and preheated using a propane torch until just before the glass begins to slump. This preheated pipette was then used to transfer 0.1 mL of the Zn—Ga—In alloy to the preheated vial containing the DEGDE. A 5 mm ultrasonic probe tapered microtip driven by a Sonics Vibra-Cell VCX 600 ultrasonic processor was then immersed approximately half of the vial height into the DEGDE. This was operated at 40% amplitude for 10 minutes, while holding the temperature constant at 200° C. via the sand bath in the heating mantle. Following processing, the vial was removed and allowed to cool to room temperature. The particles were recovered by three centrifugation/wash steps at 3000 RCF for 15 minutes followed by replacement of the supernatant with fresh ethanol. Following the final redispersion into ethanol, silica shells are deposited onto the encapsulates comprising a Ga—In liquid metal alloy core and a zinc oxide shell via the procedure for silica deposition described in Example 5. This produces the final encapsulates comprising a Ga—In liquid metal alloy core, a zinc oxide first shell, and a silica second shell.

Example 8—Production of an Encapsulate Having a Liquid Metal Core Comprising EGaIn Alloy, a First Shell Comprising Gallium Oxide and a Second Shell Comprising Iron Oxide Encapsulates comprising a liquid metal core comprising EGaIn and a first shell comprising gallium oxide are produced as in Example 4. Following production of said encapsulates, a second shell comprising iron oxide is produced via a coprecipitation method utilizing $FeSO_4$ as the source of iron, KOH as the base, and $KNO_3$ as an oxidant.

Example 9—Production of an Encapsulate Having a Liquid Metal Core Comprising EGaIn Alloy, a First Shell Comprising Gallium Oxide and a Second Shell Comprising Gadolinium Oxide Encapsulates comprising a liquid metal core comprising EGaIn and a first shell comprising gallium oxide are produced as in Example 4. Following production of said encapsulates, a second shell comprising gadolinium oxide is produced via a coprecipitation method utilizing $GdCl_3$ as the gadolinium source, diethylene glycol as the solvent for shell deposition, and water and NaOH are used as oxidants with the sample under heating.

Example 10—Production of an Encapsulate Having a Liquid Metal Core Comprising EGaIn Alloy, a First Shell Comprising Gallium Oxide and a Second Shell Comprising Indium Tin Oxide Encapsulates comprising a liquid metal core comprising EGaIn and a first shell comprising gallium oxide are produced as in Example 4. Following production of said encapsulates, a third shell comprising indium tin oxide (ITO) is produced via a sol gel method utilizing indium acetate and tin ethylhexanoate as the metal sources, n-octylether as solvent, and oleylamine and n-octanoic acid as complexation agents. Following gel formation, the as-formed gel is decomposed via heating to yield a second shell comprising ITO.

Example 11—Production of an Encapsulate Having a Liquid Metal Core Comprising EGaIn Alloy, a First Shell Comprising Gallium Oxide a Second Shell Comprising Silica, and a Third Shell Comprising Iron Oxide Encapsulates comprising a liquid metal core comprising EGaIn and a first shell comprising gallium oxide, with a second shell comprising silica are produced as in Example 4. Following production of said encapsulates, a third shell comprising iron oxide is produced via a coprecipitation method utilizing $FeSO_4$ as the source of iron, KOH as the base, and $KNO_3$ as an oxidant.

Example 12—Use of Encapsulate as a Mechanically Responsive Connector Between Electrical Elements Encapsulates prepared according to Example 4 are drop cast between two or more electrical elements such that said encapsulates make physical contact with the electrical elements and span the distance between them. Compressive force is applied between two electrical elements such that said encapsulates rupture to form an electrically conductive connection spanning the electrical elements.

Example 13—Use of Encapsulate as a Mechanically Responsive Coating on Electrical Elements to Restore Electrical Conductivity Encapsulates prepared according to Example 4 are drop cast on an electrical element such that said encapsulates makes physical contact with the electrical element. A damaging force which compromises the electrical integrity of the underlying conductive element is applied such that encapsulates rupture. After removal of the damaging force the ruptured encapsulates connect undamaged areas of the conductive element to restore conductivity across the conductive element.

Example 14—Use of Encapsulate as a Mechanically Responsive Connector Between Thermal Elements Encapsulates prepared according to Example 4 are drop cast between two or more thermal elements such that said encapsulates make physical contact with the thermal elements and span the distance between them. Compressive force is applied between two or more thermal elements such that said encapsulates rupture to form a thermally conductive connection spanning the thermal elements.

Example 15—Use of Encapsulate as a Thermally Responsive Connector Between Thermal Elements Encapsulates prepared according to Example 20 are drop cast between two or more thermal elements such that said encapsulates make physical contact with the thermal elements and span the distance between them. Thermal heating and/or cooling is applied between two thermal elements such that said encapsulates rupture to form a thermally conductive connection spanning the thermal elements.

Example 16—Use of Encapsulate as an Infrared Light Responsive Coating on Electrical Elements Encapsulates prepared according to Example 20 are drop cast on an electrical element such that said encapsulates makes physical contact with the electrical element. Infrared light of sufficient dosage is applied such that said encapsulates rupture to form a conductive film.

Example 17—Use of Encapsulate as an Intense Pulsed Light Responsive Coating on Electrical Elements Encapsulates prepared according to Example 20 are drop cast on an electrical element such that said encapsulates makes physical contact with the electrical element. Intense pulsed light of sufficient intensity is applied such that said encapsulates rupture to form a conductive film.

Example 18—Production of an Encapsulate Having a Liquid Metal Core Comprising EGaIn, a First Shell Comprising Crystalline (3-Gallium Oxide and a Second Shell Comprising Silica Encapsulates comprising an EGaIn liquid metal core, amorphous gallium oxide first shell, and silica second shell are produced as in Example 4. Following production, these encapsulates are placed in a crucible and heated to 800° C. for 12 h via a tube furnace to disproportionate and recrystallize the amorphous gallium oxide into crystalline β-gallium oxide. The Stöber silica shell also simultaneously undergoes calcination and removal of remaining organic material present in the second shell. This results in the final encapsulates having a liquid metal core comprising EGaIn liquid metal, a first shell comprising crystalline β-gallium oxide, and a second shell comprising silica.

Example 19—Production of an Encapsulate Having a Liquid Metal Core Comprising EGaIn, Optionally Comprising a Native Oxide Shell as the Innermost Shell, an Additional Shell Comprising a First Two-Dimensional Material, and a Further Shell Comprising a Second Two-Dimensional Material The procedure of example 3 is followed. The resultant particles comprising an EGaIn liquid metal core and a $MoS_2$ encapsulation are then gently washed with deionized water and recovered. Any excess water is decanted off, and then 10 mL of n-methyl-pyrrolidone containing 5 mg/mL of graphene is added to the particles. Then, water is slowly added dropwise to the solution, thereby decreasing the stability of the graphene in the solution and driving the graphene to assemble as a second shell on the encapsulates. The particles are then gently washed with deionized water to remove any unattached 2 dimensional materials.

Example 20—Production of an Encapsulate Having a First Shell Comprising a Native Oxide, and a Second Shell Comprising 2-Dimensional Materials The procedure of example 1 was followed except that 10 mL of deionized water is used in lieu of NaOH. The produced particles were gently washed with more deionized water, then dried and imaged by SEM. Distinct particles are ready apparent with graphene oxide.

Example 21—Production of an Encapsulate Having a Liquid Metal Core Comprising EGaIn, Optionally Comprising a Native Oxide Shell as the Innermost Shell, an Additional Shell Comprising a First Two-Dimensional Material, and a Further Additional Shell Comprising Silver Gallium and Indium were combined to produce a eutectic liquid alloy of GaIn (14.2 atom % In, 85.8 atom % Ga). An aliquot of 80 ul of this alloy was then added to 12 mL 0.35 mg/ml graphene oxide in water. This solution was then sonicated in a bath sonicator for 2 hours. Then, 2 mL of 1M $NH_4OH$ and 2 mL of 1.73 mg/mL sodium nitrate solutions were mixed in a separate vial and stirred for 10 minutes, before they were added to the solution containing graphene oxide and EGaIn. This new solution was stirred for another 30 minutes. Then, 17 mL of 10 mM glucose solution was added via a syringe pump at a rate of 2 mL/hour and the solution was left overnight. The resultant particles were then gently washed in DI water, dried, and imaged by SEM and clearly demonstrated an outermost shell comprising silver metal.

Every document cited herein, including any cross referenced or related patent or application and any patent application or patent to which this application claims priority or benefit thereof, is hereby incorporated herein by reference in its entirety unless expressly excluded or otherwise limited.

The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. An encapsulate comprising:

a) a liquid metal core, said liquid metal core comprising at least one of:
   (i) Hg, In, Ga and mixtures thereof, or
   (ii) an alloy comprising Hg, Sn, In, Ga and mixtures thereof; and at least one of Pb, Sb, Cd, Bi, Al, Zn, Ag, Au, or Tl;

b) one or more shells that encapsulate said liquid metal, said one or more shells comprising a first shell comprising:
   (i) a two dimensional material, said two dimensional material being selected from the group consisting of graphene oxide, graphene, modified graphene, modified graphene oxide, boron nitride, modified boron nitride, transition metal dichalcogenides, transition metal tri-chalcogenides, clays, MXenes, and mixtures thereof; or
   (ii) a charge neutral ceramic comprising an anion and a cation, each anion being independently selected from the group consisting of O, N, F, P, S, and each cation being independently select from the group consisting of Ga, In, Sn, Pb, Sb, Cd, Al, Zn, Tl, Bi, Ca, Sc, Ti, V, Cr, Sr, Y, Zr, Nb, Mo, Te, Gd, Hf, Pr, Nd, Pt, Sm, Eu, Dy, Ho, Er, Yb, Pu, with the provisos that when said cation is Ga, In and/or Sn, said encapsulate comprises a second shell selected from a ceramic, a two dimensional material selected from the group consisting of graphene oxide, graphene, modified graphene, modified graphene oxide, boron nitride, modified boron nitride, transition metal dichalcogenides, transition metal tri-chalcogenides, clays, MXenes, and mixtures thereof, or a ceramic and a two dimensional material selected from the group consisting of graphene oxide, graphene, modified graphene, modified graphene oxide, boron nitride, modified boron nitride, transition metal dichalcogenides, transition metal tri-chalcogenides, clays, MXenes, and mixtures thereof, that when said liquid metal core is Hg, said encapsulate's first shell comprises a two dimensional material selected from the group consisting of graphene oxide, graphene, modified graphene, modified graphene oxide, boron nitride, modified boron nitride, transition metal dichalcogenides, transition metal tri-chalcogenides, clays, MXenes, and mixtures thereof, and when said encapsulate's core consists of Ga and In, said encapsulate comprises a first shell encapsulating said core, said first shell consisting of amorphous gallium oxide, and a second shell encapsulating said first shell, said second shell consisting of silica, said encapsulate's Ga and In core is a 85.8 atom % Ga and 14.2 atom % In core.

2. The encapsulate of claim 1 comprising:

a) a liquid metal core, said liquid metal core comprising at least one of:
   (i) In, Ga and mixtures thereof; or
   (ii) an alloy comprising at least one of In or Ga, and at least one of Bi, Pb, Cd, or Sb;

b) one or more shells that encapsulate said liquid metal, said one or more shells comprising a first shell comprising:
   (i) a two dimensional material, said two dimensional material being selected from the group consisting of graphene oxide, graphene, modified graphene, modified graphene oxide, boron nitride, modified boron nitride, transition metal dichalcogenides, transition metal tri-chalcogenides, clays, MXenes, and mixtures thereof; or
   (ii) a charge neutral ceramic comprising an anion and a cation, each anion being independently selected from the group consisting of O, N, F, P, and S and each cation being independently select from the group consisting of Ga, In, Sn, Pb, Sb, Cd, Al, Zn, Tl, Bi, Ca, Sc, Ti, V, Cr, Sr, Y, Zr, Nb, Mo, Te, Gd, Hf, Pr, Nd, Pt, Sm, Eu, Dy, Ho, Er, Yb, Pu and mixtures thereof.

3. The encapsulate of claim 2 comprising:

a) a liquid metal core, said liquid metal core comprising at least one of:
   (i) In, Ga and mixtures thereof; or
   (ii) an alloy comprising at least one of In or Ga, and at least one of Bi or Sb;

b) one or more shells that encapsulate said liquid metal, said one or more shells comprising a first shell comprising:
   (i) a two dimensional material, said two dimensional material being selected from the group consisting of graphene oxide, modified graphene oxide, transition metal dichalcogenides, clays and mixtures thereof; or
   (ii) a charge neutral ceramic comprising an anion and a cation, each anion being independently selected from the group consisting of O, N, and F, and each cation being independently selected from the group consisting of Ga, In, Sn, Al, Zn, Sc, Ti, Cr, Zr, Nb, Gd, Nd, Sm and mixtures thereof.

4. The encapsulate of claim 3 comprising:

a) a liquid metal core, said liquid metal core comprising at least one of Ga, In and mixtures thereof;

b) one or more shells that encapsulate said liquid metal, said one or more shells comprising a first shell comprising:
   (i) a two dimensional material, said two dimensional material being selected from the group consisting of graphene oxide, modified graphene oxide and mixtures thereof; or
   (ii) a charge neutral ceramic comprising an anion and a cation, said anion being O and said cation is independently selected from the group consisting of Ga, In, Sn, Al, Zn, Gd, Nd and mixtures thereof.

5. The encapsulate according to claim 2 wherein:

a) said modified graphene is selected from the group consisting of:
   (i) a graphene surfactant mixture;
   (ii) graphene comprising a functional group that comprises oxygen;
   (iii) graphene comprising a functional group that comprises sulfur;
   (iv) graphene comprising a functional group that comprises nitrogen;

b) said modified graphene oxide is selected from the group consisting of:
   (i) reduced graphene oxide;
   (ii) graphene oxide comprising a functional group that comprises sulfur;
   (ii) graphene oxide comprising a functional group that comprises nitrogen;

c) said modified boron nitride is selected from the group consisting of:
   (i) a boron nitride surfactant mixture;
   (ii) boron nitride comprising a functional group that comprises oxygen;
   (iii) boron nitride comprising a functional group that comprises sulfur;
   (iv) boron nitride comprising a functional group that comprises nitrogen;

d) said transition metal dichalcogenides are transition metal dichalcogenides wherein said transition metal is selected from the group consisting of Ti, Zr, Hf, V, Nb, Ta, Mo, W, Tc, Re, Co, Rh, Ir, Ni, Pd, Pt and said dichalcogenides are selected from the group consisting of S, Se and Te;

e) said transition metal trichalcogenides are transition metal trichalcogenides wherein said transition metal is selected from the group consisting of Ti, Zr, Hf, Nb, Ta, and said trichalcogenides are selected from the group consisting of S, Se and Te;

f) said clay is selected from the group consisting of vermiculite, kaolin, cloisite, montmorillonite, bentonite, laponite, and mixtures thereof; and g) said MXenes are MXenes that comprise C or N; and a transition metal selected from the group consisting of Sc, Ti, V, Cr, Zr, Nb, Mo, Hf and Ta.

6. The encapsulate according to claim 5 wherein:

a) said modified graphene is selected from the group consisting of:
   (i) a graphene surfactant mixture;
   (ii) graphene comprising a functional group selected from the group consisting of carboxylates, alcohols, ketones, carbonyls, or epoxides;
   (iii) graphene comprising a functional group selected from the group consisting of sulfonates, thiols, and mixtures thereof;
   (iv) graphene comprising a functional group selected from the group consisting of amines, azides and mixtures thereof;

b) said modified graphene oxide is selected from the group consisting of:
   (i) reduced graphene oxide;
   (ii) graphene oxide comprising a functional group selected from the group consisting of sulfonates, thiols, and mixtures thereof;
   (iii) graphene oxide comprising a functional group selected from the group consisting of amines, azides and mixtures thereof;

c) said modified boron nitride is selected from the group consisting of:
   (i) a boron nitride surfactant mixture;
   (ii) boron nitride comprising a functional group selected from the group consisting of carboxylates, alcohols, ketones, carbonyls, or epoxides;
   (iii) boron nitride comprising a functional group selected from the group consisting of sulfonates, thiols, and mixtures thereof;
   (iv) boron nitride comprising a functional group selected from the group consisting of amines, azides and mixtures thereof;

d) said transition metal dichalcogenides are transition metal dichalcogenides wherein said transition metal is selected from the group consisting of Mo, and W, and said dichalcogenides are selected from the group consisting of S, Se and Te;

e) said transition metal trichalcogenides are transition metal trichalcogenides wherein said transition metal is selected from the group consisting of Ti, Zr, Hf, Nb, Ta, and said trichalcogenides are selected from the group consisting of S, Se and Te;

f) said clay is selected from the group consisting of vermiculite, kaolin, cloisite, montmorillonite, bentonite, laponite, and mixtures thereof; and g) said MXenes are MXenes that comprise C or N; and a transition metal selected from the group consisting of Sc, Ti, V, Cr, Zr, Nb, Mo, Hf and Ta.

7. The encapsulate according to claim 6 wherein:

a) said modified graphene is a graphene surfactant mixture;

b) said modified boron nitride is a boron nitride surfactant mixture; and c) said transition metal dichalcogenides are transition metal dichalcogenides wherein said transition metal is selected from the group consisting of Mo and W, and said dichalcogenides are selected from the group consisting of S and Se.

8. The encapsulate according to claim 2 wherein said transition metal dichalcogenides are transition metal dichalcogenides wherein said transition metal is Mo and said dichalcogenides are selected from the group consisting of S and Se.

9. The encapsulate according to claim 1, said encapsulate comprising one or more shells in addition to said first shell, said one or more shells encapsulating said first shell, said one or more shells comprising at least one of a ceramic, graphene oxide, graphene, modified graphene, modified graphene oxide, boron nitride, modified boron nitride, transition metal dichalcogenides, transition metal tri-chalcogenides, clays, MXenes, an elemental metal, or a polymer.

10. The encapsulate according to claim 1 wherein said encapsulate's liquid metal core comprises an alloy selected from the group consisting of:

a) Ga and In;
b) Ga, In, and Sn;
c) Ga, In, Sn and Sb;
d) In, Sn, and Bi;
e) Bi, Pb and Sn;
f) Bi, Pb, Sn and Cd;
g) Bi, Pb, Sn, Cd and In;
h) Zn, In and Ga; and
i) mixtures thereof.

11. The encapsulate according to claim 10 wherein said encapsulate's liquid metal core comprises an alloy selected from the group consisting of:

a) Ga and In;
b) Ga, In, and Sn;
c) Ga, In, Sn and Sb;

d) In, Sn, and Bi;

e) Zn, In and Ga; and f) mixtures thereof.

12. The encapsulate according to claim 10 wherein said encapsulate's liquid metal core comprises an alloy selected from the group consisting of:

a) 85.8 atom % Ga and 14.2 atom % In;

b) 78.3 atom % Ga, 14.9 atom % In, and 6.8 atom % Sn;

c) 5 atom % Zn, 20 atom % In and 75 atom % Ga; and d) mixtures thereof.

13. The encapsulate according to claim 9, said encapsulate's first shell having a shell thickness of from about 0.3 nanometers to about 10 nanometers and said one or more shells that are in addition to said first shell each having a shell thickness of from about 0.3 nanometers to about 10,000 nanometers.

14. The encapsulate according to claim 13, said encapsulate's first shell having a shell thickness of from about 0.3 nanometers to about 3 nanometers and said one or more shells that are in addition to said first shell each having a shell thickness of from about 0.3 nanometers to about 20 nanometers.

15. The encapsulate according to claim 1, said encapsulate having a principal dimension of from about 5 nanometers to about 5 millimeters.

16. The encapsulate according to claim 15, said encapsulate having a principal dimension of from about 200 nanometers to about 1,000 nanometers.

17. A method of using an encapsulate according to claim 1 comprising:

a) connecting two or more electrical connections with a connector comprising said encapsulates, said connector being a solid, a liquid or a liquid comprising a solid;

b) connecting two or more thermal connections with a connector comprising said encapsulates, said connector being a solid, a liquid or a liquid comprising a solid.

18. The method of claim 17 wherein said connector's electrical responsiveness comprises radio frequency responsiveness; said connector's photonic responsiveness comprises infrared responsiveness and/or intense pulsed light responsiveness; and said connector's mechanical responsiveness comprises tension, compression and/or shear responsiveness.

* * * * *